US007684741B2

(12) United States Patent
Sawai

(10) Patent No.: US 7,684,741 B2
(45) Date of Patent: Mar. 23, 2010

(54) IMAGE FORMING APPARATUS

(75) Inventor: Yuuji Sawai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 11/757,661

(22) Filed: Jun. 4, 2007

(65) Prior Publication Data

US 2008/0003024 A1 Jan. 3, 2008

(30) Foreign Application Priority Data

Jun. 8, 2006 (JP) ..... 2006-160211

(51) Int. Cl.
*G03G 15/01* (2006.01)

(52) U.S. Cl. ..... 399/302; 399/66; 399/303; 399/312

(58) Field of Classification Search ..... 399/302, 399/303, 308, 311, 312
See application file for complete search history.

(56) References Cited

U.S. PATENT DOCUMENTS

| | | | | |
|---|---|---|---|---|
| 5,890,030 | A | 3/1999 | Namekata et al. | |
| 6,141,522 | A * | 10/2000 | Tsuruoka et al. | 399/302 |
| 6,516,179 | B1 | 2/2003 | Sawai et al. | |
| 6,611,672 | B2 | 8/2003 | Aoki et al. | |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,768,892 | B2 | 7/2004 | Sawai | |
| 6,785,500 | B2 | 8/2004 | Takahashi et al. | |
| 6,813,471 | B2 | 11/2004 | Sawai et al. | |
| 6,823,149 | B2 | 11/2004 | Yoshikawa et al. | |
| 6,901,234 | B2 | 5/2005 | Ogiyama et al. | |
| 6,983,121 | B2 | 1/2006 | Sawai | |
| 7,003,238 | B2 | 2/2006 | Yoshida et al. | |
| 7,174,124 | B2 | 2/2007 | Ishibashi et al. | |
| 2003/0118359 | A1 | 6/2003 | Ogiyama et al. | |
| 2004/0114951 | A1 * | 6/2004 | Kawagoe | 399/66 |
| 2005/0013636 | A1 | 1/2005 | Sawai et al. | |
| 2005/0095041 | A1 * | 5/2005 | Kim et al. | 399/302 |
| 2005/0286930 | A1 | 12/2005 | Sawai et al. | |
| 2006/0056884 | A1 | 3/2006 | Sawai et al. | |
| 2006/0127116 | A1 | 6/2006 | Ogiyama et al. | |

FOREIGN PATENT DOCUMENTS

| | | |
|---|---|---|
| JP | 3079764 | 6/2000 |
| JP | 3210725 | 7/2001 |
| JP | 3649270 | 2/2005 |

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An endless belt is extended over extending rollers, and carries a toner image transferred from an image carrier or a transfer sheet. The endless belt includes a front-side reinforcing member and a rear-side reinforcing member, and a guide member for preventing meandering fixed over an approximately entire circumference on the rear-side reinforcing member. The extending rollers include a step portion provided in an end area in an axial direction facing to the rear-side reinforcing member, which has a diameter smaller than a center area in the axial direction. The front-side reinforcing member has a width wider than a width of the rear-side reinforcing member.

6 Claims, 4 Drawing Sheets

FIG. 3

| | BELT | THICK-NESS | GUIDE WIDTH | REAR REINFORCING TAPE | FRONT REINFORCING TAPE | COVERING LENGTH | RESULTS | | |
|---|---|---|---|---|---|---|---|---|---|
| | | | | | | | A PORTION | B PORTION | |
| EXAMPLE 1 | PI | 0.08mm | 5mm | 8mm | 9.50mm | 1.0mm | ○ | ○ | 200K |
| EXAMPLE 2 | PAI | 0.08mm | 5mm | 8mm | 11.50mm | 3.0mm | ○ | ○ | SHEETS EQUIVALENT TO 200K |
| EXAMPLE 3 | PC | 0.15mm | 5mm | 8mm | 13.50mm | 5.0mm | ○ | ○ | SHEETS EQUIVALENT TO 200K |
| COMPARISON EXAMPLE 1 | PI | 0.08mm | 5mm | 8mm | 9.00mm | 0.5mm | ○ | × | CRACKED WITH SHEETS EQUIVALENT TO 175K |
| COMPARISON EXAMPLE 2 | PAI | 0.08mm | 5mm | 8mm | 8.00mm | −0.5mm | ○ | × | CRACKED WITH SHEETS EQUIVALENT TO 138K |
| COMPARISON EXAMPLE 3 | PC | 0.15mm | 5mm | 8mm | 7.00mm | −1.5mm | ○ | × | CRACKED WITH SHEETS EQUIVALENT TO 130K |
| COMPARISON EXAMPLE 4 | PI | 0.08mm | 5mm | 8mm | 0mm | −8.5mm | × | | CRACKED WITH SHEETS EQUIVALENT TO 68K |

IMAGE FORMING APPARATUS

CROSS-REFERENCE TO RELATED APPLICATIONS

The present document incorporates by reference the entire contents of Japanese priority document, 2006-160211 filed in Japan on Jun. 8, 2006.

BACKGROUND OF THE INVENTION

1. Field of the Invention

The present invention relates to a technology for forming an image through an electrophotographic process by using an intermediate transfer member formed of an endless belt, with a capability of preventing an occurrence of a crack at an edge of the endless belt and an expansion of the endless belt.

2. Description of the Related Art

In an electrophotographic image forming apparatus, an electrostatic latent image formed on an image carrier (photosensitive member) based on optical image information, such as document reflected light, or electric image information from a host machine is developed by using toner supplied from a developing device as a toner image, and this toner image is transferred onto a transfer sheet and then fixed for image formation.

In a multicolor image forming apparatus that forms a full-color image by using toners of yellow, magenta, cyan, and black, it is generally the case that a scheme is adopted such that toner images of different colors formed on one or a plurality of image carriers are sequentially superposed on an intermediate transfer belt for transfer, thereby forming a superposed toner image, and then the superposed toner image on the intermediate transfer belt is transferred onto a transfer sheet for secondary transfer.

Also, an image forming apparatus has been known that is provided with a transfer belt that carries a transfer sheet to a transfer position when a toner image on an image carrier is transferred onto the transfer sheet.

Both the intermediate transfer belt and the transfer belt have a structure for extending an endless belt with extending rollers for running.

In this type of endless belt, stable and smooth running is important in increasing the quality of an image to be formed. For example, if the endless belt is deviated even slightly in a width direction or meandering, degradation in image quality is inevitable.

To get around this problem, as depicted in FIG. 4 for explaining a belt end supporting structure, a guide member 101 for preventing meandering is provided along the back surface of an edge in an width direction of an intermediate transfer belt (transfer belt) 100 as an endless belt, and an inner end of the guide member 101 is bumped against an end (step portion) 110*a* of an extending roller 110, thereby preventing meandering. That is, a deviation force occurring at the intermediate transfer belt 100 inward in a width direction (axial direction) is resolved by receiving the guide member 101 provided on the back of the belt end at the end of the extending roller, thereby preventing a shift.

In FIG. 4, when the belt is shifted inward in the width direction (leftward), the guide member 101 and the roller end 101*a* make contact with each other at an A portion. With a shifting force, the guide member 101 receives a force of mounting on a circumferential surface of the extending roller 110. Therefore, the force concentrates on the A portion of the belt. The guide member 101 receives this force while being wound around the extending roller 110, and is released from this force when being separated. However, a load occurring due to this repeated force on the A portion is so significant that a crack tends to occur on the intermediate transfer belt 100 from the A portion as a starting point. That is, the intermediate transfer belt 100 receives the force mainly at the guide member end A and, when the belt is in a state of slightly mounting on the circumferential surface of the roller or a state of being separated from the roller, the shifting force is lost. With the repetition of load and separation of the shifting force, a crack tends to occur on the belt.

As depicted in FIG. 5, which is a drawing of the structure of another conventional example, to prevent a crack of the belt occurring by the force on the guide member 101, a rear-side reinforcing member (reinforcing tape) 105 is provided on the back of the edge in the width direction of the intermediate transfer belt 100, and the guide member 101 is disposed on the surface of the rear-side reinforcing member 105. However, with the provision of the rear-side reinforcing member 105 on the back of the belt end, the reinforcing tape portion when being wound around the roller will bring an effect similar to that in which the circumferential length of the belt is shortened by the thickness. Therefore, since a belt conveying speed is partially different, the intermediate transfer belt 100 may be deformed. To get around this deformation problem, as depicted in the drawing, a roller step portion 111 is provide to decrease an end diameter of the extending roller 110 according to the thickness of the rear-side reinforcing member 105, thereby solving an influence due to the thickness of the reinforcing member. However, with this configuration, a corner portion B of the roller step portion 111 and the intermediate transfer belt 100 rub in a sliding manner, thereby wearing the belt and causing a crack to tend to occur. Moreover, such a belt crack tends to occur from the end in a width direction. Once a small crack occurs at the end of the belt, the crack is spread. Once a crack occurs at the belt end, the rear-side reinforcing member 105 almost cannot prevent the spread of the crack.

To get around this, as depicted in the drawing, a front-side reinforcing member (reinforcing tape) 106 is provided on the front of the belt end. A crack prevention effect of the front-side reinforcing member is stronger than that of the rear-side reinforcing member but, if the width of the front-side reinforcing member is narrower than the width of the rear-side reinforcing member, a crack may occur outside of the reinforcing members, thereby posing a problem in durability.

In a further explanation, different schemes of attaching a reinforcing member to prevent a crack on a belt are used according to the belt characteristics and system. There are a pattern in which a reinforcing member is provided only on the back of the belt, a pattern in which a reinforcing member is provided only on the front of the belt, and a pattern in which reinforcing members are provided on both of the front and back of the belt. Furthermore, there is a pattern in which a belt shift is controlled without providing a reinforcing member.

Effects of preventing the occurrence of a crack of various reinforcing members included in the intermediate transfer belt 100 with its back provided with the guide member 101 are considered to be increased in the order of (1) a rear-side reinforcing member, (2) a front-side reinforcing member, and then (3) reinforcing members provided on both of the front and back surfaces. That is, the effect of preventing the occurrence of a crack is weak with a single rear-side reinforcing member, whilst this effect is maximized with reinforcing members provided on both of the front and back surfaces.

In the case of (1) the rear-side reinforcing member 105, when a crack occurs on the belt end, the crack is spread at the time of extending the belt by the extending roller. Thus, once a crack occurs, an effect of preventing a spread of the crack is weak. Also, with the provision of the rear-side reinforcing member, an area where the reinforcing member is provided brings an effect similar to that in which the circumferential length of the belt is shortened by the tape thickness. A portion away from a portion in close contact with the extending roller 110 occurs, and therefore the intermediate transfer belt 100 tends to be wavy. When the intermediate transfer belt 100 becomes wavy, a detection failure may occur when a toner pattern is formed on the belt and this toner pattern is detected by a sensor. Furthermore, a difference in circumferential length between portions in a belt width direction will bring a difference in belt running speed. That is, the belt speed of the portion where the rear-side reinforcing member 105 is provided is higher than the belt speed of a portion where no reinforcing member is provided. As a result, the belt tends to be shifted inward in a width direction, thereby causing a crease in the belt.

In the case of (2) the front-side reinforcing member 106, the belt end is sandwiched with the guide member 101. Therefore, even if a crack occurs at the belt end, the crack is prevented from spreading. However, since there is no member for reinforcing a joint between the ends in a circumferential direction of the guide member 101, a crack tends to occur at a portion of the belt corresponding to the joint.

In the case of (3) the reinforcing members on both of the front and back surfaces, the both of the front and back surfaces of the intermediate transfer belt 100 are sandwiched by the reinforcing members 105 and 106. Therefore, an effect of reinforcement against a crack from the belt end is strong. However, it is often the case that the width of the front-side reinforcing member 106 and the width of the rear-side reinforcing member 105 are equal to each other or the front-side reinforcing member is shorter than the rear-side reinforcing member, and a step portion formed between an inner edge of the front-side reinforcing member 106 and a belt surface are not covered. Therefore, when reinforcing members are provided on both of the front and back surfaces of the belt, although the crack prevention effect against a crack from the belt end surface is strong, an effect of preventing a crack occurring from a step portion inside of the reinforcing member is weak.

Japanese Patent No. 3210725 discloses a technology in which, in an image forming apparatus that cleans the belt surface with a blade, a rear-side reinforcing tape is provided along the belt edge, and a step is provided at the roller end facing to this reinforcing tape. This conventional technology, however, is to ensure flatness of the belt by providing a step at the roller end for blade cleaning, and no mention is found about the occurrence of a crack due to the step and its prevention or about a front-side reinforcing tape.

Japanese Patent No. 3079764 discloses a structure in which a reinforcing tape is provided on each of the both of the front and back surfaces of a belt. However, the width of the front reinforcing tape is equal to the width of the back reinforcing tape, and a step corresponding to the reinforcing tape width is not provided on a roller side. Therefore, an effect of preventing a crack occurring from a step between an inner edge of the reinforcing tape and a belt surface cannot be expected.

Japanese Patent Application Laid-Open No. 11-219046 relates to a front-side reinforcing tape. However, only a guide member is provided on the back of a belt, and no rear-side reinforcing tape is provided. Therefore, no step portion is provided on the roller. Therefore, an effect of preventing a crack occurring from a step portion between an inner edge of the front-side reinforcing tape and a belt surface cannot be expected.

Furthermore, no explanation about a crack occurrence portion and a reinforcing tape requiring crack prevention is present in any of the conventional technologies mentioned above.

SUMMARY OF THE INVENTION

It is an object of the present invention to at least partially solve the problems in the conventional technology.

An image forming apparatus according to one aspect of the present invention includes an image carrier that carries a toner image; and an endless belt that is extended over a plurality of extending rollers, and carries either one of the toner image transferred from the image carrier and a transfer sheet. The endless belt includes a front-side reinforcing member and a rear-side reinforcing member fixed over an approximately entire circumference on front and back surfaces of both edges in a width direction, and a guide member for preventing meandering fixed over an approximately entire circumference on the rear-side reinforcing member. Each of the extending rollers includes a step portion provided in an end area in an axial direction facing to the rear-side reinforcing member, the step portion having a diameter smaller than a center area in the axial direction. The front-side reinforcing member has a width wider than a width of the rear-side reinforcing member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a table for illustrating a comparison between embodiment examples according to the present invention and comparison examples;

DETAILED DESCRIPTION OF THE PREFERRED EMBODIMENTS

Exemplary embodiments of the present invention are explained in detail below with reference to the accompanying drawings.

Figure 1:
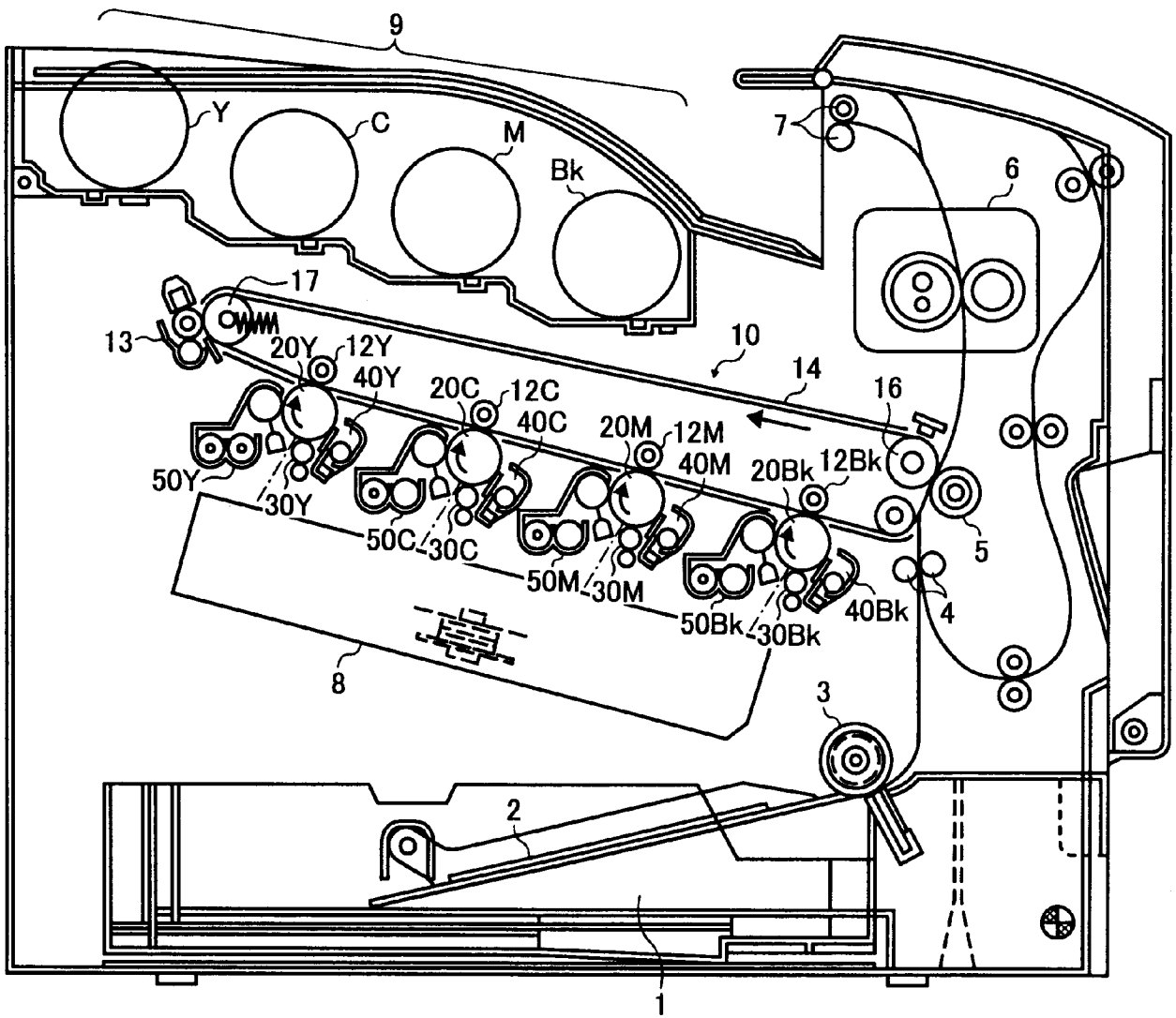
FIG. 1 is a drawing of a schematic configuration of one example of a color image forming apparatus provided with an endless belt supporting mechanism according to the present invention.

FIG. 1 is a drawing of a schematic configuration of one example of a color image forming apparatus provided with an endless belt supporting mechanism according to the present invention.

This color image forming apparatus includes, for example, a transfer belt unit 10 having an intermediate transfer belt 71, which is an endless belt, four image stations linearly disposed, a paper-feeding cassette (paper feeding unit) 1, and a writing device 8.

Each image station has disposed therein a relevant one of image carriers (photosensitive drums) 20Y, 20C, 20M, and 20K, a relevant one of charging devices 30Y, 30C, 30M, and 30K, a relevant one of developing devices 50Y, 50C, 50M, and 50K, a relevant one of cleaning devices 40Y, 40C, 40M, and 40K. Toner bottles 9 are disposed in the order of, from the left in the drawing, yellow (Y), cyan (C), magenta (M), and black (K) toners, supplying a predetermined supply amount to the developing devices 50Y, 50C, 50M, and 50K by a toner conveying mechanism not shown.

Upon a print signal, a transfer sheet 2 goes out from the paper feeding cassette 1 by a paper feeding roller 3, and the tip of the transfer sheet 2 is sent to resist rollers 4. The sent transfer sheet is detected by a sensor to see whether a jam has occurred. In synchronization with an image signal, the transfer sheet is then sent from the resist rollers to a transfer position.

On the other hand, on the image carrier 20, which is uniformly charged by the charging device 30 according to a print signal, an electrostatic latent image corresponding to the image signal is formed by the writing device 8. Each electrostatic latent image is developed by a relevant one of the developing devices 50Y, 50C, 50M, and 50K that accommodates a toner with a color corresponding to the electrostatic latent image to form a toner image.

The toner images formed on the image carriers 20Y, 20C, 20M, and 20K are sequentially transferred on the intermediate transfer belt 71 with a transfer voltage applied from initial transfer rollers 12Y, 12C, 12M, and 12K to form a superposed toner image.

The superposed toner image formed on the intermediate transfer belt 71 is conveyed to a position of a secondary transfer roller 5, and is then transferred on the transfer sheet 2 with a transfer electric field applied between the secondary transfer roller 5 and a facing roller 16. With this, the superposed toner image is formed on the transfer sheet.

The transfer sheet 2 having the superposed toner image formed thereon is then conveyed to a fixing device 6, where the toner image is fixed, and is then delivered by delivering rollers 7 onto a paper delivery tray.

Toners left on the image carriers 20Y, 20C, 20M, and 20K are removed from each cleaning device, and is charged by a charging device with an alternating current superposed on a direct current simultaneously with static elimination, thereby preparing for the next image formation.

The toner left on the intermediate transfer belt 71 is removed by an intermediate transfer belt cleaning device 13.

The charged intermediate transfer belt 71 is attenuated through natural discharge while rotation and the contact with a grounded intermediate transfer belt cleaning facing roller, thereby preparing for the next step.

A belt crack occurring at an edge in a width direction of the intermediate transfer belt is explained below.

Figure 2A:
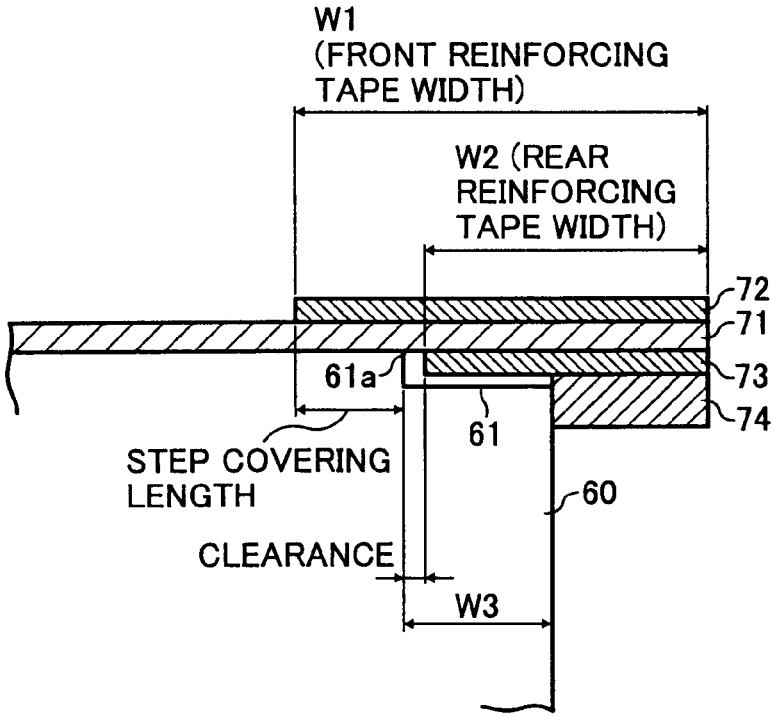
FIG. 2A is a front longitudinal section view of a main configuration of an endless belt supporting mechanism according to an embodiment of the present invention.
Figure 2B:
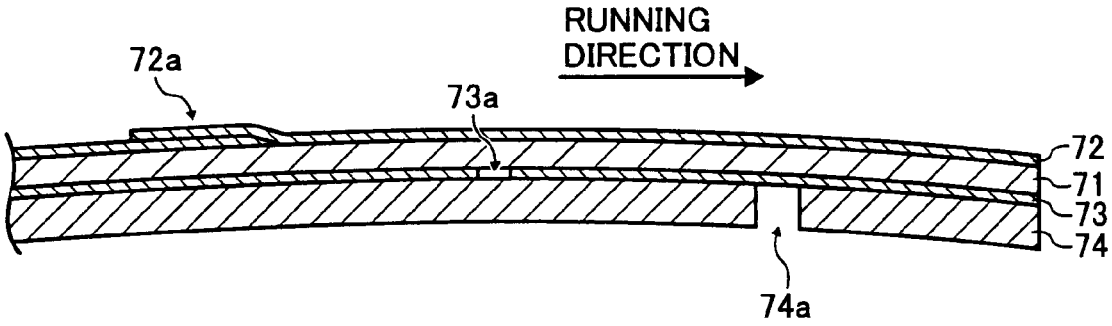
FIG. 2B is a right side view of the main configuration of an endless belt supporting mechanism according to the embodiment.
Figure 4:
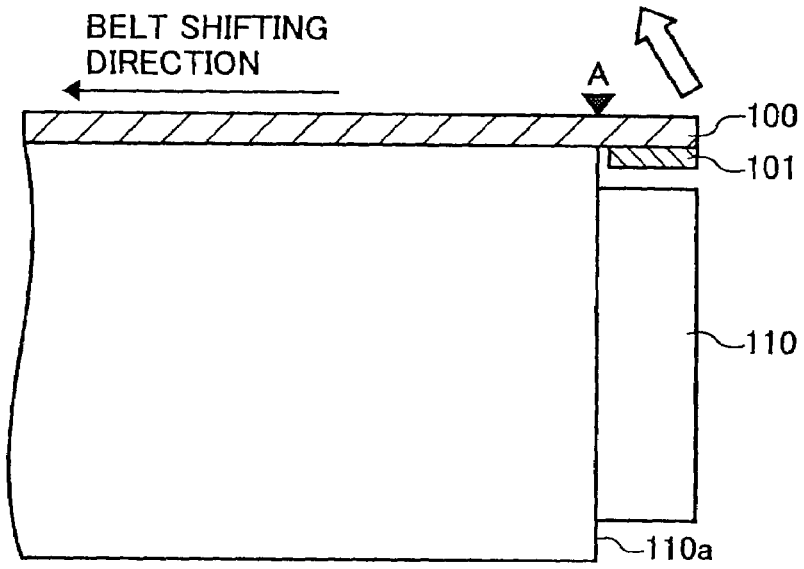
FIG. 4 PRIOR ART
FIG. 4 is a drawing for explaining a conventional belt edge supporting structure.
Figure 5:
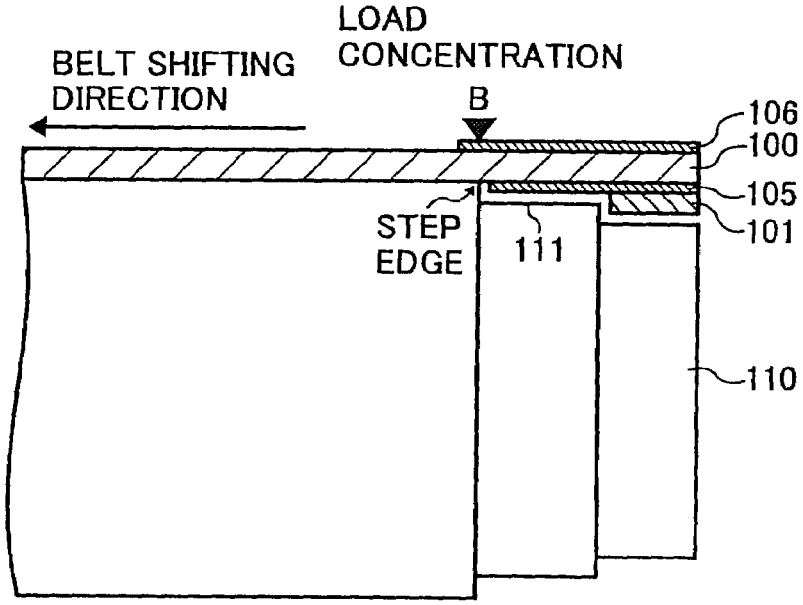
FIG. 5 PRIOR ART
FIG. 5 is a drawing for explaining another conventional example.

FIG. 2A is a front longitudinal section view of a main configuration of an endless belt supporting mechanism according to one embodiment of the present invention, and FIG. 2B is a right side view thereof.

The endless belt supporting mechanism relates to a structure of an end in a width direction (axial direction) when the intermediate transfer belt 71 is extended by an extending roller (for example, equivalent to a roller 16 in FIG. 1).

A front-side reinforcing tape (front-side reinforcing member) 72 along the front surface of the belt edge, a rear-side reinforcing tape (rear-side reinforcing member) 73 along the back surface of the belt edge, and a guide member 74 for preventing meandering fixed onto the back-surface reinforcing tape are provided over an approximately entire circumference of both edges in the width direction of the intermediate transfer belt 71. An extending roller 60 has a step portion 61 in an end area in an axial direction facing to the rear-side reinforcing tap 73, the step portion 61 having a diameter smaller than a center area in the axial direction.

A height dimension (a difference in diameter dimension) of the step portion 61 is set larger than the thickness of the rear-side reinforcing tape 73. If the height of the step portion is lower than the thickness of the rear-side reinforcing tape, a belt portion where the rear-side reinforcing tape is provided can be considered as that the circumferential length is partially shortened. With this, a decrease in speed and a degradation in belt running ability occur at that portion, and the belt tends to be wavy. On the other hand, if the height dimension of the step portion 61 is excessively larger than the thickness of the rear-side reinforcing tape, a belt portion facing the step portion 61 falls in to an extending roller side to break. This causes a local load, and therefore a belt crack tends to occur.

A characteristic structure of the present invention is that a width dimension W1 of the front-side reinforcing tape 72 is wider than a width W2 of the rear-side reinforcing tape 73. In this manner, with the width W1 of the front-side reinforcing tape being wider than the width W2 of the rear-side reinforcing tape, a lift of the intermediate transfer belt 71 can be prevented to eliminate the occurrence of a belt wrinkle at the time of conveyance. Also, with the provision of the front-side reinforcing tape 72, the occurrence of a crack at the time of conveyance can be prevented.

With the provision of the front-side reinforcing tape 72, a reinforcing effect can be increased on the load on the guide member 74, and therefore a crack tends not to occur.

Furthermore, the width W1 of the front-side reinforcing tape 72 is wider than a width W3 of the step portion 61 having a small diameter provided at the end in the axial direction of the extending roller 60. With this, the occurrence of a belt crack due to the load on the belt at the end of the extending roller can be prevented.

In particular, the inner edge of the front-side reinforcing tape 72 is positioned to project to an inner side from a corner 61*a* of the step portion 61 by a distance equal to or greater than one millimeter. With this, the occurrence of a belt crack at the end of the roller can be more effectively prevented.

By adopting the structure depicted in FIG. 2B together with or aside from the structure of the endless belt supporting mechanism depicted in FIG. 2A, a more excellent effect can be achieved.

That is, an endless belt supporting mechanism has a feature in which a position of a joint portion 72*a* in a circumferential direction where both ends of the front-side reinforcing tape 72 in the circumferential direction are adjacent to each other is shifted from a position of a joint portion 73*a* in the circumferential direction where both ends of the rear-side reinforcing tape 73 in the circumferential direction are adjacent to each other, and has a feature in which each of the joint portions 72*a* and 73*a* is shifted in circumferential position from (is disposed to be separated from) a joint portion 74*a* where both ends of the guide member 74 in the circumferential direction are adjacent to each other.

Each of the reinforcing tapes 72 and 73 and the guide member 74 is attached by being bonded along the circumferential length of the mounting surface on a belt side. Therefore, both ends of each tape and the guide member are generally fixed onto the belt surface to be adjacent to each other. Since a belt portion corresponding to each of the joint portions 72*a*, 73*a*, and 74*a* has a decreased supporting strength, a crack tends to occur.

According to the present invention, both ends of the front-side reinforcing tape 72 in the circumferential direction not interfering the extending roller 60 are superposed (overlapped) each other for joint. Also, as for both ends of the rear-side reinforcing tape 73 in contact (interfering) with the extending roller 60 and the guide member 74, their both ends in the circumferential direction are disposed to be adjacent to each other without being superposed.

In this manner, the position of the joint portion 72*a* of the front-side reinforcing tape 72 in the circumferential direction is shifted from the position of the joint portion 73*a* of the rear-side reinforcing tape 73 in the circumferential direction, or the positions of the joint portions 72*a* and 73*a* of the reinforcing tapes 72 and 73 are shifted from the position of the joint portion 74*a* of the guide member 74 in the circumferential direction. With this, the occurrence of a crack due to insufficient strength of the belt surface where each joint is positioned can be prevented. Furthermore, at the same time, a long-life endless belt with a belt speed being unchanged can be provided.

In particular, as for the front-side reinforcing tape 72 in which an inconvenience can be prevented by superposing both of their ends in the circumferential direction, one end is superposed on the other end, thereby supplementing a decrease in belt strength.

When both ends of the front-side reinforcing tape 72 are superposed each other for joint and a running direction of the intermediate transfer belt 71 is assumed to be a rightward direction in FIG. 2B, it is preferable that the end on a downstream side in the running direction (right side) be superposed on the end on an upstream side (left side). If the end on the downstream side in the running direction is superposed on a lower side of the end on the upstream side, the end on the upstream side tends to be peeled off in relation to the running direction. That is, in the case of adopting the structure in which the attached toner is cleaned by causing the surface of the intermediate transfer belt to be slidably in contact with a tip edge of a cleaning blade not shown (cleaning device 13 in FIG. 1), a sealing member for preventing a leakage of toner provided in a connecting manner at both ends of the cleaning blade is slidably in contact with the joint portion 72*a* of the front-side reinforcing tape. Even in this case, a scarfing of the tape end can be prevented, thereby achieving a long life.

Furthermore, according to the present invention, any of polyimide, polyamid-imide, polycarbonate and others with high strength is selected as a material of the intermediate transfer belt 71, thereby preventing the occurrence of a crack and achieving a long life.

A table in FIG. 3 depicts examples according to the present invention and comparison examples. The contents of the table are explained in detail below.

Example 1

An intermediate transfer belt, a guide member, and a reinforcing tape have the following configuration.

Intermediate Transfer Belt

Material: polyimide

Thickness: 0.08 millimeters

Modulus of elasticity: 4500 megapascals

Guide Member

Material: polyurethane

Width: 5.0 millimeters

Thickness: 0.7 millimeters

Gap between ends in a circumferential direction: 2 millimeters

Reinforcing tape (both front and back)

Material: polyethylene terephthalate (PET)

Thickness: 0.025 millimeters (base layer)

Gap between ends of a rear-side reinforcing tape in a circumferential direction: 2 millimeters Ends of a front-side reinforcing tape in a circumferential direction: laminated with superposition of 10 millimeters in the forward direction The width of the rear-side reinforcing tape is ensured to be 8 millimeters, and a distance between the step portion and the rear-side reinforcing tape with the guide member being bumped against the roller end is ensured to be 0.5 millimeters, thereby preventing a mount of the roller on the rear-side reinforcing tape.

The width of the front-side reinforcing tape is 9.5 millimeters, and the width to cover the corner of the step portion is 1.0 millimeter. As the amount of shifting in the belt width direction is larger, the load on the guide member is larger, and therefore a belt crack tends to occur. Therefore, the amount of belt shifting is set at 30 μm/mm. This amount of shifting is 1.5 times as much as a target amount of shifting.

Under the conditions mentioned above, durability evaluation was performed in an intermittent paper through mode with an image formation mode of 1 to 5. With intermediate transfer belt durable specifications and 200K sheets, no crack occurred.

An A portion indicates an end of the guide member, whilst a B portion indicates a step portion. By taking these portions as starting points, whether a crack has occurred was evaluated.

Example 2

Intermediate transfer belt

Material: polyamide-imide

Thickness: 0.08 millimeters

Modulus of elasticity: 4800 megapascals

Intermediate transfer belt durable specifications

No crack occurred with 200K sheets

Example 3

Intermediate Transfer Belt

Material: polycarbonate

Thickness: 0.15 millimeters

Modulus of elasticity: 3200 megapascals

Intermediate transfer belt durable specifications

No crack occurred with 200K sheets

Comparison Example 1

Intermediate Transfer Belt

Material: polyimide

Thickness: 0.08 millimeters

Modulus of elasticity: 4500 megapascals

A crack occurred from a portion corresponding to the step portion with 175K sheets Comparison Example 2

Intermediate Transfer Belt

Material: polyamide-imide

Thickness: 0.08 millimeters

Modulus of elasticity: 4800 megapascals

A crack occurred from a portion corresponding to the step portion with 138K sheets Comparison Example 3

Intermediate Transfer Belt

Material: polyamide-imide

Thickness: 0.08 millimeters

Modulus of elasticity: 4800 megapascals

A crack occurred from a portion corresponding to the step portion with 130K sheets Comparison Example 4

Intermediate Transfer Belt

Material: polyimide

Thickness: 0.08 millimeters

Modulus of elasticity: 4500 megapascals

A crack occurred from a portion corresponding to the guide-member edge with 68K sheets Although the intermediate transfer belt has been mainly explained as an endless belt in the present embodiment, the present invention can also be applied to a transfer belt that absorbs a transfer sheet at a transferring position for conveyance and other endless belts.

According to one aspect of the present invention, the endless belt is provided with reinforcing members and a guide member for preventing meandering over an entire circumference at both ends in a width direction. Each extending rollers is provided with a step portion provided in an end area facing to reinforcing members having a diameter smaller than a center area. The reinforcing members are provided on front and back surfaces of the endless belt. The front-side reinforcing member has a width wider than a width of the rear-side reinforcing member. With this, a lift of the belt can be eliminated to avoid the occurrence of a belt wrinkle due to conveyance. Also, with the provision of the front and back reinforcing tapes, a belt crack can be prevented.

Furthermore, according to another aspect of the present invention, the front-side reinforcing member has a width wider than that of the step portion with a small diameter provided to an end of each of the extending rollers. With this, a belt crack due to a load on the belt at the roller end can be prevented from occurring.

Moreover, according to still another aspect of the present invention, the step portion is covered for a distance equal to or greater than one millimeter by the front-side reinforcing member. With this, a belt crack due to the end of the rollers can be prevented from occurring.

Furthermore, according to still another aspect of the present invention, joint portions of the guide member and the front and back reinforcing tapes are shifted from one another, both ends of the rear-side reinforcing member are not superposed each other, and both ends of the front-side reinforcing member are superposed each other. With this, a belt crack can be prevented from occurring at a portion where the strength of the joint portion is insufficient, and the need for superposing the ends of the rear-side reinforcing tape is eliminated. With this, a long-life endless belt with a belt speed being unchanged can be provided.

Moreover, according to still another aspect of the present invention, even a seal at an end of the cleaning blade or the like rubs in a sliding manner, a scarfing of an end of the reinforcing member can be prevented from occurring, thereby achieving a long life.

Furthermore, according to still another aspect of the present invention, polyimide, polyamide-imide, or polycarbonate with high strength is applied to the endless belt. With this, a crack can be prevented from occurring, thereby achieving a long life.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a toner image; and an endless belt that is extended over a plurality of extending rollers, and carries either one of the toner image transferred from the image carrier and a transfer sheet, wherein the endless belt includes a front-side reinforcing member and a rear-side reinforcing member fixed over an approximately entire circumference on front and back surfaces of both edges in a width direction, and a guide member for preventing meandering fixed over an approximately entire circumference on the rear-side reinforcing member, each of the extending rollers includes a step portion provided in an end area in an axial direction facing to the rear-side reinforcing member, the step portion having a diameter smaller than a center area in the axial direction, and the front-side reinforcing member has a width wider than a width of the rear-side reinforcing member, wherein joint portions of the front-side reinforcing member and the rear-side reinforcing member and a joint portion where both ends of the guide member in a circumferential direction are disposed to be separated from each other, are shifted in position from each other in the circumferential direction.

2. The image forming apparatus according to claim 1, wherein the width of the front-side reinforcing member is wider than a width of the step portion of the extending roller.

3. The image forming apparatus according to claim 2, wherein an inner edge in a width direction of the front-side reinforcing member projects to an inner side from a corner of the step portion of the extending roller by a distance equal to or greater than one millimeter in a width direction.

4. The image forming apparatus according to claim 1, wherein a joint portion where both ends of the front-side reinforcing member in a circumferential direction are adjacent to each other and a joint portion where both ends of the rear-side reinforcing member are adjacent to each other in a circumferential direction are disposed to be separated from each other to be shifted in position in the circumferential direction from each other, the both ends of the front-side reinforcing member in the circumferential direction are fixed in a state where one of the ends is superposed on another one of the ends, and the both ends of the rear-side reinforcing member in the circumferential direction are disposed to be adjacent in a non-superposing state.

5. The image forming apparatus according to claim 4, wherein one of the both ends in the circumferential direction of the front-side reinforcing member on a downstream side of in a running direction of the endless belt is fixed in a state in which the end is superposed on another end that is on an upstream side thereof.

6. The image forming apparatus according to claim 1, wherein the endless belt has either one of a single-layer structure formed of any one of polyimide, polyamide-imide, and polycarbonate and a multilayer structure formed of a plurality of materials thereof.

* * * * *